United States Patent [19]

Stanley, Jr.

[11] 4,116,357

[45] Sep. 26, 1978

[54] TANK WITH WATER-SEALABLE VENT

[75] Inventor: Marion L. Stanley, Jr., Toledo, Ohio

[73] Assignee: Owens-Corning Fiberglas Corporation, Toledo, Ohio

[21] Appl. No.: 826,581

[22] Filed: Aug. 22, 1977

[51] Int. Cl.[2] ..... B65D 51/16; B65D 53/06

[52] U.S. Cl. ..... 220/205; 220/208; 220/228; 220/366

[58] Field of Search ..... 220/373, 205, 352, 353, 220/366, 228, 208; 215/307, 234

[56] References Cited

U.S. PATENT DOCUMENTS

| | | | |
|---|---|---|---|
| 297,668 | 4/1884 | Brownstein | 220/228 |
| 459,598 | 9/1891 | Stiles | 220/366 |
| 702,584 | 6/1902 | Paquette | 220/228 |
| 1,490,186 | 4/1924 | Rowe | 220/205 |
| 1,754,091 | 4/1930 | Friedman | 220/228 |
| 1,874,742 | 8/1932 | Harnsberger | 220/228 |
| 2,946,476 | 7/1960 | Ross | 220/228 |

*Primary Examiner*—William Price
*Assistant Examiner*—Allan N. Shoap
*Attorney, Agent, or Firm*—Ronald C. Hudgens; Patrick P. Pacella; Paul J. Rose

[57] ABSTRACT

The top wall portion of the tank has a vent structure including a first tubular projection in communication with the inside of the tank and a second tubular projection of larger diameter mounted on the top wall portion in surrounding relationship with the first tubular projection. A cap is mounted on the first tubular projection, a skirt portion being disposed in the annular space between the first and second tubular projections. Water fill means are provided on the second tubular projection for filling the annular space with water to a depth covering the bottom of the skirt portion of the cap.

4 Claims, 8 Drawing Figures

TANK WITH WATER-SEALABLE VENT

This invention relates generally to storage tanks, and more particularly to storage tanks made of glass fiber reinforced plastic and used to store industrial chemicals.

Tall storage tanks are normally filled generally from the bottom and vented at the top. In the past, fumes from the industrial chemicals stored in the tanks were allowed to escape continuously through the vent. In accordance with my invention, a water-seal is provided in the tank vent and most of the fumes from the industrial chemicals are retained within the tank, whereby air pollution is reduced. As a secondary consideration, the vent structure of my invention acts as a relief valve against sudden surges of pressure which can occur during filling of the tank. This is important when the tank is made of glass fiber reinforced plastic. Such tanks normally have circumferential reinforcement for withstanding pressure of the stored liquid, but are not normally designed to withstand gaseous pressure against the underside of the wall.

An object of the invention is to provide a tank with a water seal in a vent to prevent continuous escape of fumes of stored industrial chemicals.

Another object is to provide such a tank with relief against sudden surges of gaseous pressure.

Other objects and advantages will become apparent when the following specification is considered along with the accompanying drawings in which.

Figure 1:
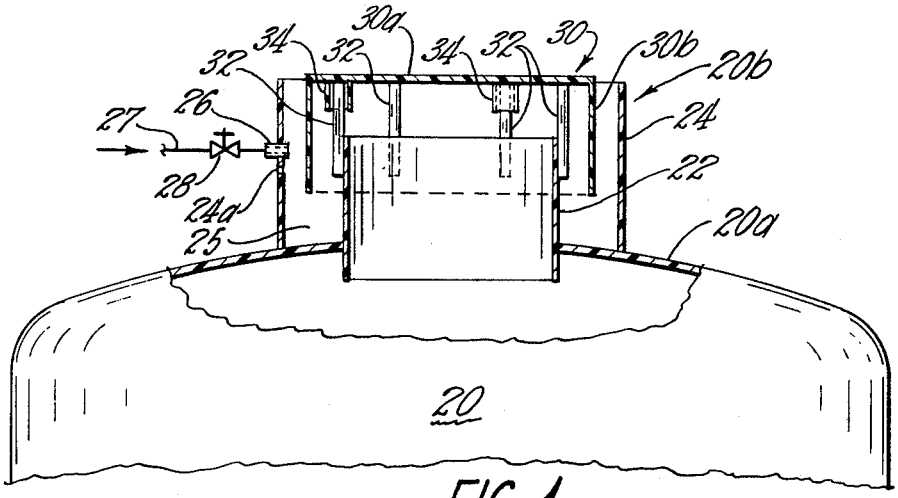
FIG. 1 is a fragmentary elevational view, partially in section, of a tank constructed in accordance with the invention.
Figure 2:
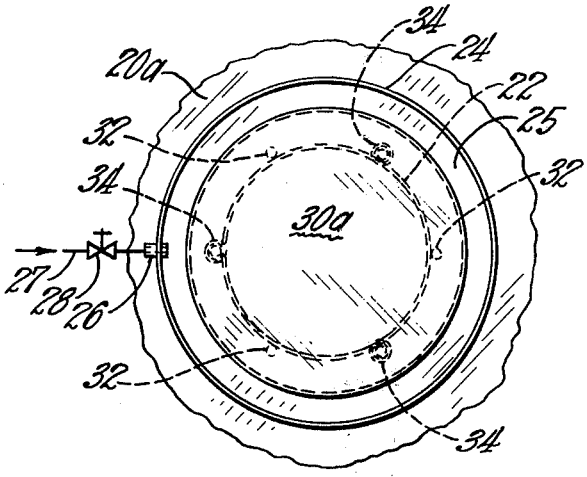
FIG. 2 is a fragmentary plan view of the tank of FIG. 1.

With respect to the drawings, FIGS. 1 and 2 fragmentarily show a vented tank 20 constructed in accordance with the invention and including a top wall portion 20*a* and a vent structure 20*b*. The vent structure 20*b* includes a first tubular projection 22 extending from the top wall portion 20*a* and communicating with the inside of the tank, and a second tubular projection 24, of larger diameter than the first tubular projection 22, mounted on the outside of the top wall portion 20*a* concentrically of the first tubular projection 22. In conjunction with the top wall portion 20*a*, the tubular projections 22 and 24 form an annular container defining an annular space 25 for water which forms a seal for retaining gaseous fumes in the tank. A fitting 26 is mounted in the tubular projection 24. A water supply line 27 having an adjustable valve 28 therein is normally attached to the fitting 26 to provide a continuous supply of water in hot weather. The tubular projection 24 is provided with an outlet aperture 24*a* which determines the depth of the water in the annular container.

Figure 3:
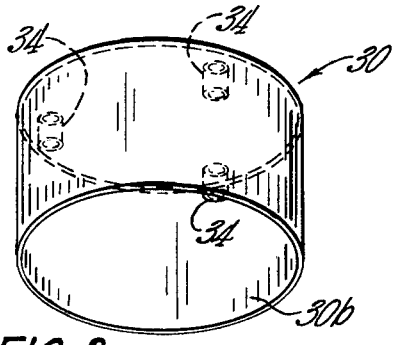
FIG. 3 is a perspective view of a cap forming part of the vent structure of the tank of FIGS. 1 and 2.
Figure 4:
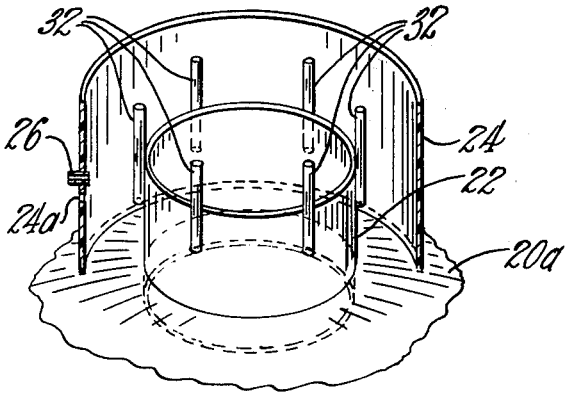
FIG. 4 is a fragmentary perspective view, partially in section, of the vent structure of the tank of FIGS. 1 and 2 with the cap removed.

A cap 30 best shown in FIG. 3 and including a flat circular closure portion 30*a* and an annular skirt portion 30*b* is mounted on the tubular projection 22. The skirt portion 30*b* is disposed in the annular space 25. Spacing means is provided for maintaining the closure portion 30*a* in spaced relationship to the outer end of the tubular projection 22 and the skirt portion 30*b* in spaced relationship to the top wall portion 20*a*. In the embodiment shown, the spacing means is a plurality of rods 32 best shown in FIG. 4 and secured to the tubular projection 22 preferably in uniformly spaced relationship therearound. The rods 32 project beyond the outer end of the tubular projection 22 and normally engage the closure portion 30*a*. Three sleeves 34 are secured to the underside of the closure portion 30*a* in position for receiving three of the rods 22 to maintain the cap 30 concentric with the tubular projections 22 and 24. The bottom of the skirt portion 30*b* is normally below the outlet 24*a*. The tubular projection 22 forms a primary vent for the tank, the space between the tubular projection 24 and the skirt portion 30*b* forms a secondary vent for the tank and the water in the space 25 forms a water seal obstructing gaseous communication between the primary and secondary vents.

Figure 5:
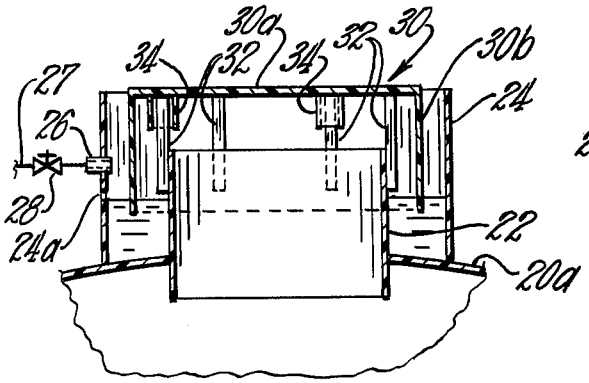
FIG. 5 is a fragmentary vertical sectional view of the vent structure of the tank of FIG. 1 and including a water seal shown with atmospheric pressure in the tank.

In FIG. 5, with atmospheric pressure in the tank, the level of the water on opposite sides of the skirt portion 30*b* is the same and fumes of industrial chemical are sealed in the tank.

Figure 6:
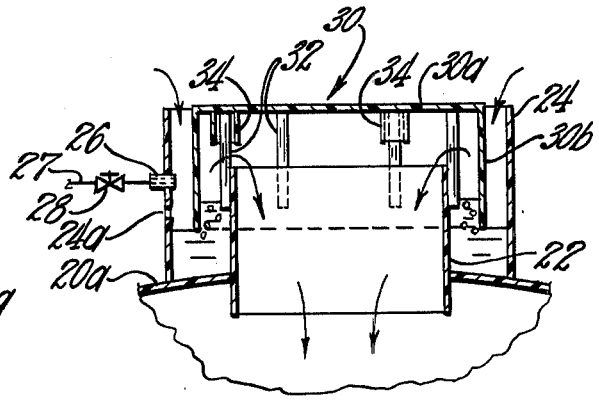
FIG. 6 is a view similar to FIG. 5, but with a vacuum in the tank.

In FIG. 6, with a vacuum in the tank, the level of the water on the inner side of the skirt portion 30*b* is increased and the level on the outer side is decreased and bubbles of air may become entrained in the water and allow air to enter the tank.

Figure 7:
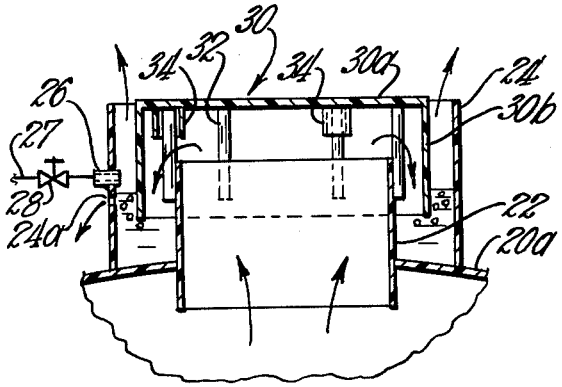
FIG. 7 is a view similar to FIGS. 5 and 6, but with gaseous pressure in the tank.

In FIG. 7, with gaseous pressure in the tank greater than atmospheric pressure, the level of the water on the inner side of the skirt portion 30*b* is decreased and the level on the outer side is increased and bubbles of industrial chamical gas may become entrained in the water and escape to the atmosphere while the tank is being filled.

Figure 8:
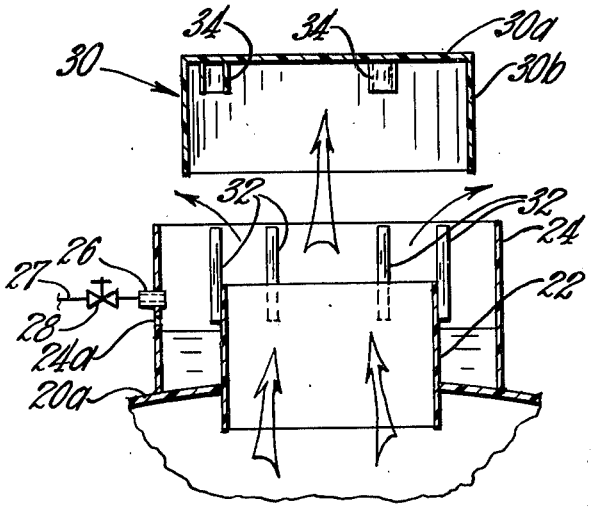
FIG. 8 is a view similar to FIGS. 5–7, but showing the cap blown off the rest of the vent structure by a sudden surge of gaseous pressure.

In FIG. 8, under a sudden surge of gaseous pressure, the cap 30 is blown off to relieve the pressure and protect the tank.

Various modifications may be made in the structure shown and described without departing from the spirit and scope of the invention.

I claim:

1. A corrosion resistant vented storage tank formed of glass fiber reinforced plastic and comprising a tank having a top wall portion, a first tubular projection extending upwardly from the top wall portion and communicating with the inside of the tank, a second tubular projection of larger diameter than that of the first, the second tubular projection being mounted on the outside of the top wall portion in concentrically spaced relationship to the first tubular projection, the tubular projections and the portion of the top wall portion therebetween providing an annular container for water, a plurality of vertically extending rods secured to the first tubular projection in spaced relationship to each other therearound and projecting upwardly beyond the outer end thereof, a cap including a flat circular unvented closure portion and a depending annular skirt portion of a diameter intermediate those of the tubular projections, the skirt portion being disposed in concentrically spaced relationship to the tubular projections, and a plurality of sleeves secured to the underside of the closure portion of the cap and respectively slidably receiving upper end portions of the rods, the rods normally engaging the closure portion of the cap and maintaining it in spaced relationship from the outer end of the first tubular projection and maintaining the lower end of the annular skirt in spaced relationship from the top wall portion of the tank.

2. A storage tank as claimed in claim 1 wherein the second tubular projection is provided with a fitting for the connection of a water supply line thereto and with an outlet aperture for determining the level of water in the annular space.

3. A storage tank as claimed in claim 2 wherein a lower edge of the skirt portion of the cap is normally disposed below the outlet aperture.

4. A corrosion resistant vented storage tank formed of glass fiber reinforced plastic and comprising a tank having a top wall portion, a first tubular projection extending upwardly from the top wall portion and communicating with the inside of the tank, a second tubular projection of larger diameter than that of the first, the second tubular projection being mounted on the outside of the top wall portion in concentrically spaced relationship to the first tubular projection, the tubular projections and the portion of the top wall portion therebetween providing an annular container for water, a cap including a flat circular unvented closure portion and a depending annular skirt portion of a diameter intermediate those of the tubular projections, the skirt portion being disposed in concentrically spaced relationship to the tubular projections, and cooperative slidingly engageable vertically extending rod and sleeve means on the cap and on the first tubular projection reciprocably mounting the cap with respect to the tubular projections and maintaining the closure portion of the cap in spaced relationship from the outer end of the first tubular projection and the lower end of the annular skirt in spaced relationship from the top wall portion of the tank.

* * * * *